US006070326A

United States Patent [19]

Berns

[11] Patent Number: 6,070,326

[45] Date of Patent: Jun. 6, 2000

[54] RAZOR KNIFE WITH RETRACTABLE BLADE GUARD

[75] Inventor: Harald Berns, Wuppertal, Germany

[73] Assignee: Martor-Argentax E.H. Beermann KG, Solingen, Germany

[21] Appl. No.: 09/330,299

[22] Filed: Jun. 11, 1999

[51] Int. Cl.[7] ..... B26B 29/02

[52] U.S. Cl. ..... 30/2; 30/293; 30/294

[58] Field of Search ..... 30/2, 162, 293, 30/294, 335, 336

[56] References Cited

U.S. PATENT DOCUMENTS

| | | | |
|---|---|---|---|
| 142,942 | 7/1873 | Ratelle . | |
| 2,743,523 | 5/1956 | Honey . | |
| 4,086,698 | 5/1978 | Sparks . | |
| 4,192,066 | 3/1980 | Tucker | 30/162 |
| 4,393,587 | 7/1983 | Kloosterman . | |
| 4,569,133 | 2/1986 | Schmidt . | |
| 5,325,594 | 7/1994 | Szafranski . | |

FOREIGN PATENT DOCUMENTS

| | | |
|---|---|---|
| 1 121 972 | 8/1960 | Germany . |
| 31 16 354 | 11/1982 | Germany . |
| 34 33 286 | 4/1985 | Germany . |
| 35 40 026 | 5/1988 | Germany . |

*Primary Examiner*—Douglas D. Watts
*Attorney, Agent, or Firm*—Herbert Dubno; Andrew Wilford

[57] ABSTRACT

A knife has an elongated handle having an outer end and a longitudinally extending flat blade secured in the handle and projecting from the outer end. The blade has a transverse outer edge and a longitudinally extending side cutting edge meeting at a point. The handle is formed with a pair of longitudinally outwardly open and longitudinally extending guides flanking the blade adjacent the cutting edge thereof. Respective longitudinally extending pins having generally parallel and transversely projecting outer ends sections are longitudinally displaceable in the guides between extended positions with the outer end sections lying longitudinally outward of the point and retracted positions with the outer end sections longitudinally rearward of the point and the blade passing between the outer end sections. Respective springs braced between the pins and the handle urge the pins into the extended positions.

5 Claims, 4 Drawing Sheets

RAZOR KNIFE WITH RETRACTABLE BLADE GUARD

FIELD OF THE INVENTION

The present invention relates to a razor knife. More particularly this invention concerns such a knife with a blade guard.

BACKGROUND OF THE INVENTION

A standard utility knife has an elongated handle having an outer end and a longitudinally extending flat blade secured in the handle and projecting outwardly from the outer end. The blade has a transverse outer edge and a longitudinally extending side or front cutting edge meeting at a point. Such a knife is useful for opening packages, including cartons and bags, and is typically carried in the pocket or tool belt of the person using it.

In order to protect the user from injury by the cutting edge and point it is known from German patent 3,116,354 and U.S. Pat. No. 4,086,698 to form the handle with a longitudinally outwardly open and longitudinally extending guide slightly offset laterally from the cutting edge of the blade. A longitudinally extending pin has an outer end carrying a bumper or shield and is longitudinally displaceable in the guide between an extended positions with the outer end lying longitudinally outward of the point and a retracted position with the outer end longitudinally inward of the point. A spring is braced between the pin and the handle and urges the pin into the extended position.

Thus to use such a knife the shield end of the guard pin is pressed against the item to be cut or slit until it is pushed inward past the point which can then cut into the item. The guard does indeed protect against casual contact with the point, but is not suitable for use in opening a bag as the guard can easily get caught in the slit being cut, for instance if the knife is moved briefly backward. Furthermore when used on particularly thick bag materials, such as thick plastic sheeting or fabric of multiple layers, it is quite hard to use.

German utility model 1,899,717 describes a system where a protective cap is urged outward past the blade and can be pressed inward against spring force to let the blade project through a slit in the cap for a combined stabbing/cutting operation as in opening a bag. A similar pivotal U-shaped cap is also described in German patent document 1,121,972. These systems are particularly unsuitable for opening bags and the caps do not move reliably and the knife must be brought at a specific angle into engagement with the bag.

In U.S. Pat. No. 5,325,594 of Szanfranski a knife has a pivotal U-shaped guard that serves for protecting the blade and compressing the item being slit. A catch is operated to retract the guard and, once the catch is operated, the blade is left sticking out and is not protected at all.

The system of U.S. Pat. No. 4,393,587 of Kloosterman has a blade mounted on a carrier so it can be pushed against a spring force through an end guard. The guard at the end is configured to make it hard for the blade to poke through a bag and then slide along it.

In U.S. Pat. No. 2,743,523 there is a double bow-formation to each side of the outer region of a square blade. This double guard assembly is made of elastic material so it must be deformed as the knife is pulled along something to be cut. Such a knife is almost impossible to use in a stabbing/cutting operation.

Finally, U.S. Pat. No. 4,569,133 of Schmidt had a blade fixed in the handle but projecting through a shield whose longitudinal position can be set to establish an exact depth of cut. This guard is not normally movable and normally the blade always projects outward past it, so it does not really allow the tool to be pocketed when not in use.

OBJECTS OF THE INVENTION

It is therefore an object of the present invention to provide an improved razor-type utility knife.

Another object is the provision of such an improved razor-type utility knife which overcomes the above-given disadvantages, that is which is particularly safe and suited to opening of bags.

SUMMARY OF THE INVENTION

A knife has according to the invention an elongated handle having an outer end and a longitudinally extending flat blade secured in the handle and projecting from the outer end. The blade has a transverse outer edge and a longitudinally extending side cutting edge meeting at a point. The handle is formed with a pair of longitudinally outwardly open and longitudinally extending guides flanking the blade adjacent the cutting edge thereof. Respective longitudinally extending pins having generally parallel and transversely projecting outer ends sections are longitudinally displaceable in the guides between extended positions with the outer end sections lying longitudinally outward of the point and retracted positions with the outer end sections longitudinally rearward of the point and the blade passing between the outer end sections. Respective springs braced between the pins and the handle urge the pins into the extended positions.

Thus in the extended position the cutting edge and point are effectively protected. Since the two parts of the guide flank the blade, it is unlikely that they can slip into a slit made by the blade, and they will serve to make taut the region of the bag being cut. The guards do not interfere with the user's view of the cut either and spread out the force exerted by the knife on the bag so that they themselves are unlikely to poke through the bag. These end sections also allow the knife when it is being used on a box to move easily around a corner.

The blade according to the invention is generally trapezoidal and its outer and side edges extend at an acute angle to each other. This makes the knife particularly suitable for stabbing a hole, then cutting a slit.

The outer end sections have outer ends that are joined so that both pins move synchronously. In one arrangement the pins are unitary with each other and the outer ends are joined together at bight portion extending perpendicular to a plane of the blade. Here the bight portion and end sections together form a U through which the blade passes in the retracted position of the pins. In another arrangement the outer ends are each provided with a respective straight guide portion projecting rearward parallel to the respective pin. The handle is formed with a longitudinally outwardly open and longitudinally extending guide slidably receiving the guide portions and these guide portions have inner ends that are joined together at a bight portion.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
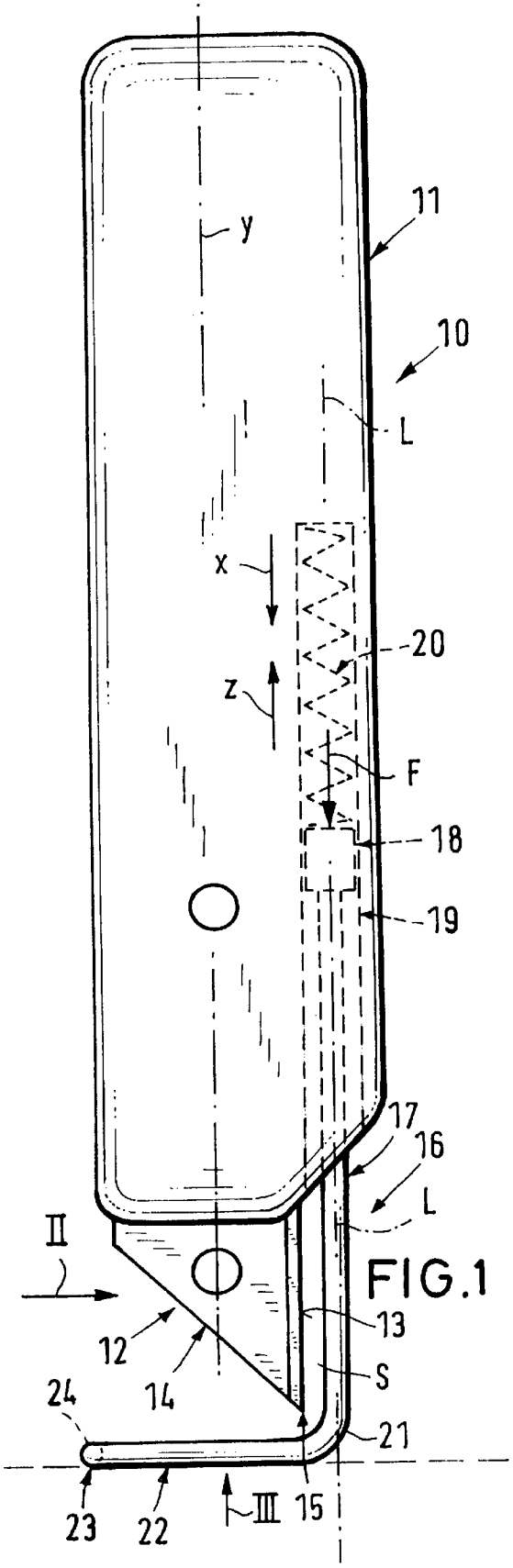
FIGS. 1 and 1A are side views of a knife according to the invention with the blade guard in the extended and retracted positions, respectively.
Figure 3:
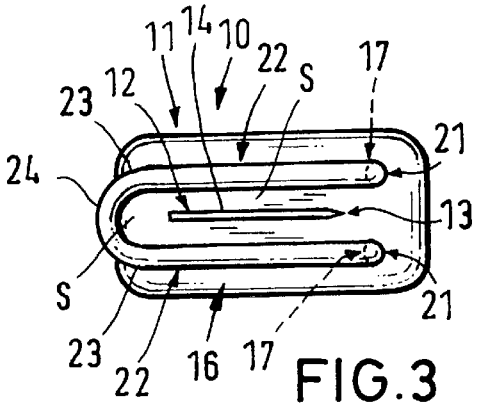
FIGS. 2 and 3 are rear-side and outer-end views taken in the direction of respective arrows II and III of FIG. 1.
Figure 2:
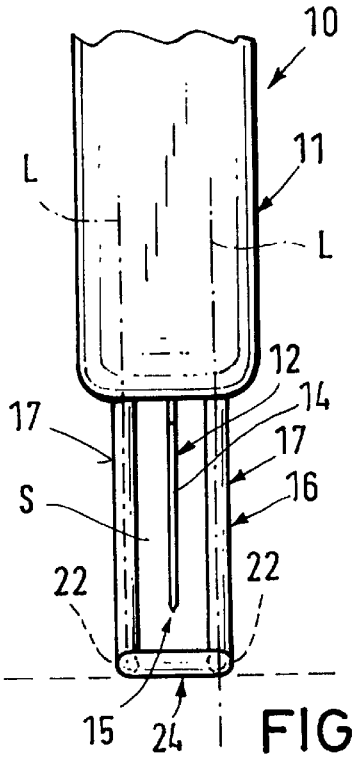
Figure 1A:
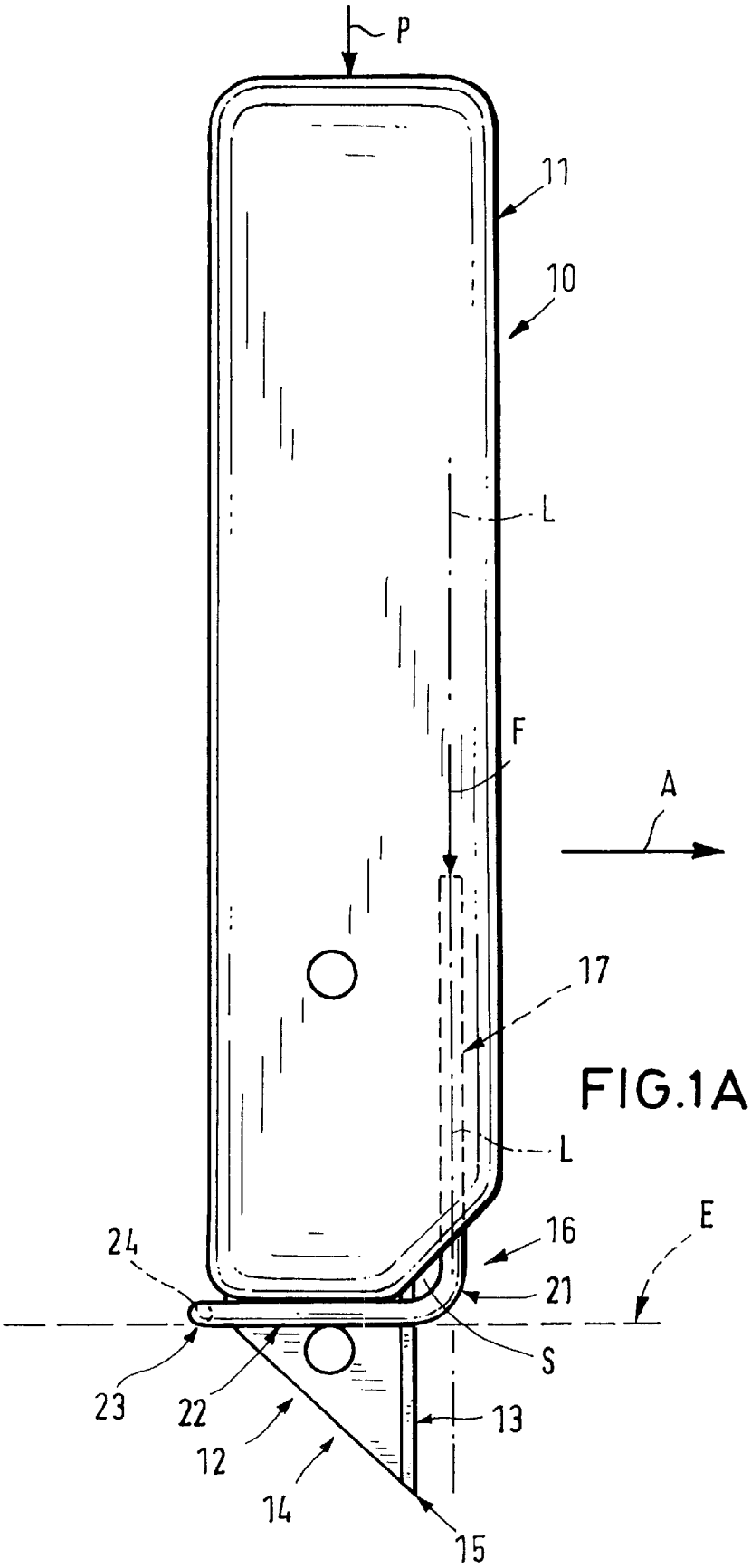

As seen in FIGS. 1, 1A, 2, and 3, a bag-opening knife 10 according to the invention has an elongated handle 11 centered on a longitudinal axis y and holding a standard trapezoidal razor blade 12 having a longitudinal front cutting edge 13 and an outer end edge 14 extending at a 45° angle thereto to form a point 15 therewith. A guard 16 is formed as two cylindrical and straight pins 17 centered on respective axes L parallel to the axis y and equidistantly symmetrically flanking the plane of the blade 12 but at a slight spacing laterally from the side cutting edge 13 thereof. Rear ends 18 of the pins 17 are formed as pistons slidable in respective outwardly open guide bores 19 formed in the handle 11. Respective springs 20 braced in the guide bores 19 between the inner ends 18 and the floors of these bores 19 force the pins 17 longitudinally outward with a force F in an outward direction x. These springs 20 can be compressed on movement of the pins 17 inward in a rearward retracting direction z.

The pins 17 are connected at elbows at their outer ends 21 to respective straight end sections extending perpendicular to the axes y and L and having outer ends 23 interconnected by a web 24 extending perpendicular to the plane of the blade 12. Thus the guard 16 is formed by a single piece of wire and moves longitudinally as a unit.

More specifically, FIG. 1 shows the knife 10 with the guard 16 in the extended position in which its pins 17 extend along and outward of the cutting edge 13 and its outer sections 22 lie longitudinally outward of the outer edge 14 of the blade 12. In this position the dangerous cutting edge 13 and the point 15 are recessed in the guard 16. When the knife 10 is pressed in direction P (FIG. 1A) into something that is to be cut, as for instance a bag, the two sections 22 first come to rest on it. In the case of a bag these sections 22 pull the bag taut between themselves on a plane E as the knife 10 is pressed into the bag until the spring force F is overcome and the guard 16 starts to retract inward in direction z. The point 15 will therefore pierce easily through the taut region of bag between the sections 22 as the guard moves into the retracted position of FIG. 1A, whereupon movement of the entire knife in the forward direction of arrow A will slit the bag open neatly. The guard therefore not only serves to protect the user from the blade 12 when the knife 10 is not in use, but it also facilitates use of the knife.

Figure 4:
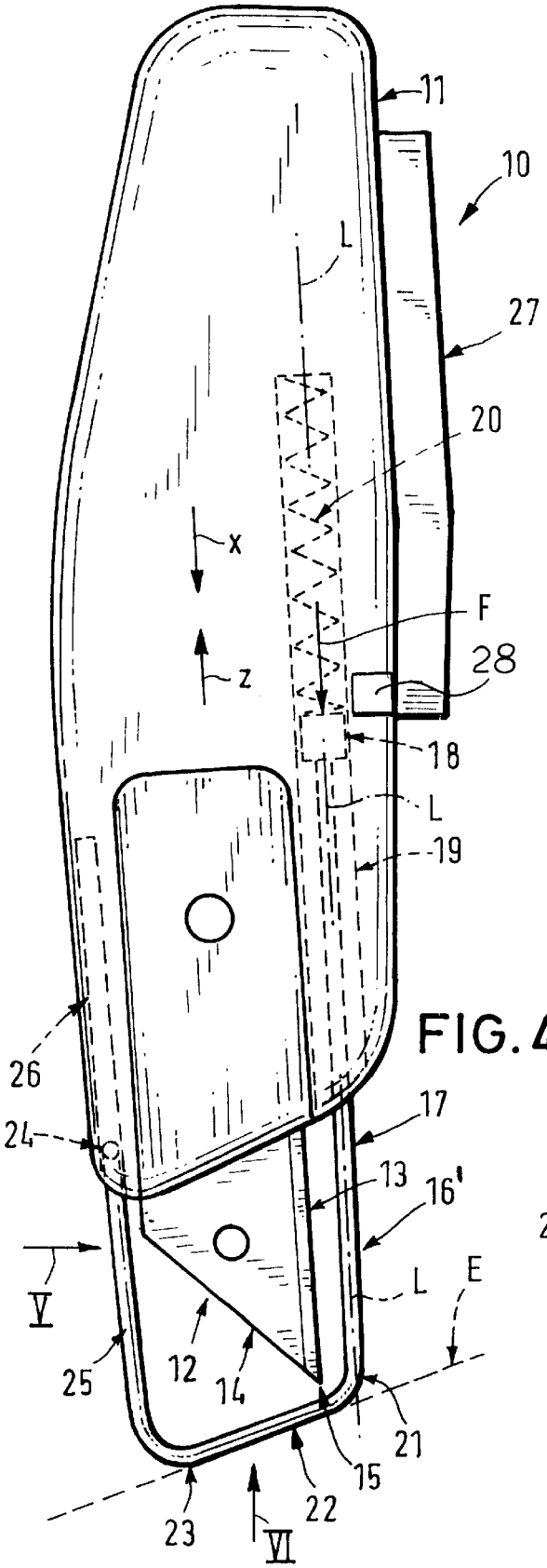
FIGS. 4 and 4A are side views of another knife according to the invention with the blade guard in the extended and retracted positions, respectively.
Figure 5:
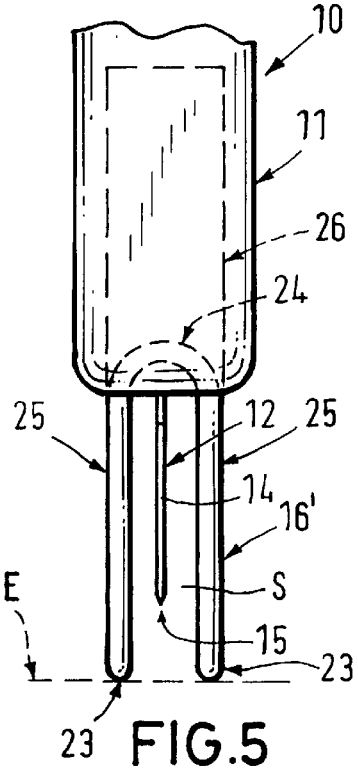
FIGS. 5 and 6 are rear-side and outer-end views taken in the direction of respective arrows V and VI of FIG. 4.
Figure 6:
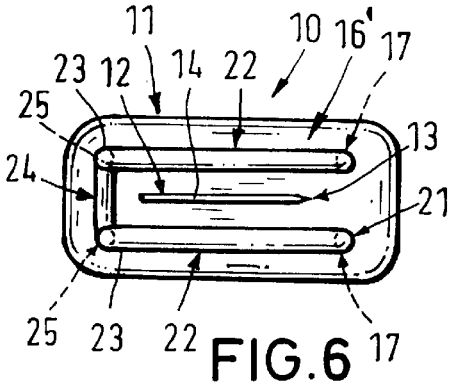
Figure 4A:
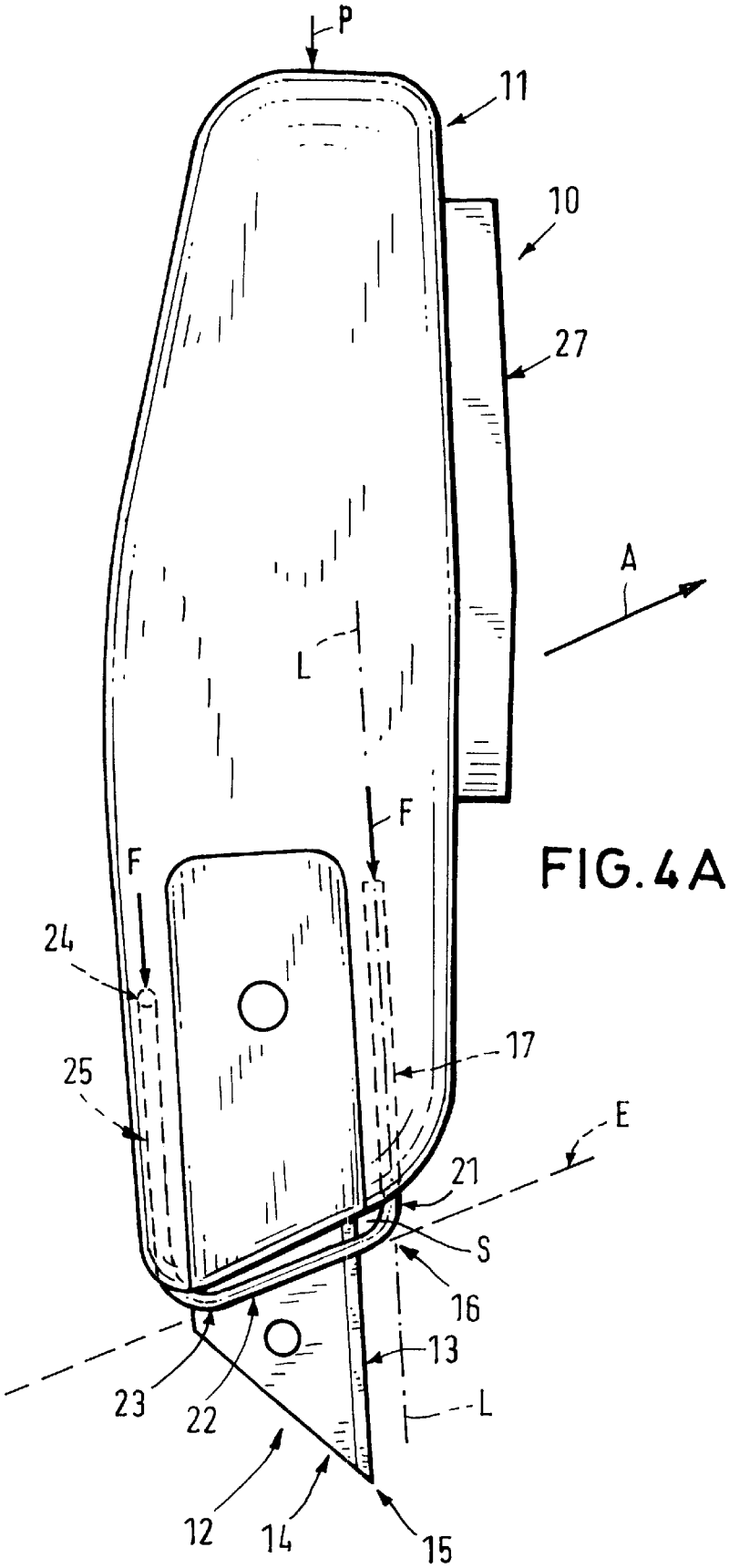

The system of FIGS. 4 to 6 is of substantially identical construction except that the outer ends 23 of the outer sections 22 are extended inward and guide pins 25 that fit in a guide slot 26 running along a back-side edge of the blade 22 in the handle body 11 and the inner ends of these guide pins 25, which are parallel to the pins 17, are joined together by the bight 24. Thus the guard 16' completely surrounds the blade 12.

In addition here the outer sections 22 do not lie in a plane E perpendicular to the axes L, but at a slightly acute angle thereto. A transversely depressible and longitudinally extending finger grip 27 can actuate a stop mechanism 28 to block rearward movement of at least one of the rear pin ends 18. Thus only when the spring grip 27 is depressed can the pin 17 move inward past the mechanism 28, but even if the grip 27 is held down, once the force pushing the guard 16' inward is released, it will slide outward past the mechanism 28 to reset itself in the extended position. The grip 28 will have to be actuated again to allow the guard 16' to retract again.

I claim:

1. A knife comprising:

an elongated handle having an outer end;

a longitudinally extending flat blade secured in the handle and projecting from the outer end, the blade having a transverse outer edge and a longitudinally extending side cutting edge meeting at a point, the handle being formed with a pair of longitudinally outwardly open and longitudinally extending guides flanking the blade adjacent the cutting edge thereof;

respective longitudinally extending pins having generally parallel and transversely projecting outer ends sections having outer ends that are joined together at a bight portion extending perpendicular to a plane of the blade, the bight portion and end sections together forming a U through which the blade can pass, the pins being longitudinally displaceable in the guides between extended positions with the outer end sections lying longitudinally outward of the point and retracted positions with the outer end sections longitudinally rearward of the point and the blade passing between the outer end sections; and respective springs braced between the pins and the handle and urging the pins into the extended positions.

2. The knife defined in claim 1 wherein the blade is generally trapezoidal and its outer and side edges extend at an acute angle to each other.

3. The knife defined in claim 1 wherein the outer ends are each provided with a respective straight guide portion projecting rearward parallel to the respective pin.

4. The knife defined in claim 3 wherein the handle is formed with a longitudinally outwardly open and longitudinally extending guide slidably receiving the guide portions.

5. The knife defined in claim 3 wherein the guide portions have inner ends that are joined together at a bight portion.

* * * * *